US005273257A

United States Patent [19]

Perkins

[11] Patent Number: 5,273,257

[45] Date of Patent: Dec. 28, 1993

[54] APPARATUS FOR CONTROLLING MOVEMENT OF A TETHER IN A CONDUIT

[76] Inventor: John J. Perkins, 3789 Toronto Rd., Cameron Park, Calif. 95682

[21] Appl. No.: 818,393

[22] Filed: Jan. 2, 1992

Related U.S. Application Data

[63] Continuation of Ser. No. 531,032, May 31, 1990, abandoned.

[51] Int. Cl.[5] ..... B66D 1/00

[52] U.S. Cl. ..... 254/375; 254/323; 254/365

[58] Field of Search ..... 254/134.4, 323, 356, 254/365, 375, 378; 15/104.061, 104.31

[56] References Cited

U.S. PATENT DOCUMENTS

| | | | |
|---|---|---|---|
| 1,110,004 | 9/1914 | Overly et al. | 254/378 X |
| 1,139,131 | 5/1915 | Macfarlane et al. | 254/378 X |
| 1,446,562 | 2/1923 | Hickman | 254/358 |
| 1,478,272 | 12/1923 | Boulanger | 254/358 |
| 1,534,538 | 4/1925 | Norris | 192/1.38 |
| 1,779,480 | 10/1930 | Loomis | 254/358 |
| 1,875,467 | 9/1932 | Knoerzer et al. | 15/104.31 |
| 1,877,408 | 9/1932 | Launder et al. | 254/378 X |
| 2,023,828 | 12/1935 | Wilson | 254/358 |
| 2,028,701 | 1/1936 | Guier et al. | 254/323 |
| 2,108,319 | 2/1938 | Perkins | 118/306 |
| 2,187,623 | 1/1940 | Maier | 254/358 |
| 2,334,207 | 11/1943 | Lamberton | 254/365 |
| 2,650,065 | 8/1953 | Young | 254/358 |
| 2,668,307 | 2/1954 | Preen | 15/104.61 |
| 2,794,197 | 6/1957 | Crane | 15/104.61 |
| 2,980,399 | 4/1961 | Littlefield | 254/134.4 |
| 3,088,709 | 5/1963 | Hunt | 254/323 |
| 3,160,904 | 12/1964 | Swanson | 15/104.31 |
| 3,224,733 | 12/1965 | Ensley | 254/134.3 R |
| 3,291,452 | 12/1966 | Rau et al. | 254/358 |
| 3,351,968 | 11/1967 | Masters | 15/104.31 |
| 3,370,599 | 2/1968 | Ciaccio | 134/167 C |
| 3,522,815 | 8/1970 | Prange | 15/104.31 |
| 3,742,548 | 7/1973 | Ciaccio | 15/104.31 |
| 3,829,064 | 8/1974 | Jackson | 254/323 |
| 4,011,100 | 3/1977 | Ross | 134/8 |
| 4,336,074 | 6/1982 | Dinkelacker | 134/8 |
| 4,464,806 | 8/1984 | Prange | 15/104.3 SN |
| 4,896,686 | 1/1990 | Schmidt, Jr. et al. | 254/323 |

*Primary Examiner*—Katherine Matecki
*Attorney, Agent, or Firm*—Joseph E. Gerber

[57] ABSTRACT

Apparatus for controlling movement of a tether in a conduit is disclosed, the apparatus being comprised of a winch, two braking systems, a pair of extensible stabilizer bars and a crossbar for engaging an opening. The winch is engine-driven and mounted on a frame having wheels. Engine power is delivered through a dog clutch to a cable spool through a reduction sprocket set. A brake control arm having a friction pad positioned thereupon to bear against the spool and having a hand grip connected to a drum brake in the drive train is provided. A power arm operable to control the dog clutch and including a throttle tab is also provided. A level winding arm is positioned to be swept across the spool for even cable storage. A pair of stabilizer bars are extensible from the frame and have screw jacks at their ends which mate with a crossbar adapted to engage an opening such as a manhole. The screw jacks are operable to bias the apparatus' weight against the crossbar.

12 Claims, 8 Drawing Sheets 86
62
90
80
88
50
10
20
18
44
46
106
126
108
42
48
100
106
118
108
118
99
100
114
12
14
126
11
16
116
94
134
130
132

APPARATUS FOR CONTROLLING MOVEMENT OF A TETHER IN A CONDUIT

This is a continuation of U.S. Ser. No. 07/531,032 filed on May 31, 1990, now abandoned.

BACKGROUND OF THE INVENTION

1. Field Of The Invention

The present invention relates generally to apparatus for controlling deployment and retrieval of a tether, and more specifically to apparatus for moving tethered instruments to and fro in a conduit such as a sewer pipe.

2. Description Of The Related Art

The interior of a narrow conduit is inherently difficult to access, as when it comes time for its inspection or cleaning. For example, sewer pipes and like conduits routinely become obstructed by roots, dirt, grit, grease and encrustation which must be removed to keep the flow moving freely. Sewer pipe cleaning is often performed by guiding a spirally-ribbed, resilient ball through the pipe on a cable, the ball being driven from behind by water pressure.

The apparatus heretofore directed to this task is manually-operated and includes a cable spool supported on a frame comprised of a pair of A-shaped members. The cleaning ball is attached to the end of the cable and a crank handle is provided on the spool. In operation, the cable spool is positioned on its frame adjacent a manhole at the upstream end of a sewer pipe. Then, the ball and its trailing cable are fed into the pipe. A head of water is built up in the manhole behind the ball, driving it downstream. Cleaning is most effectively accomplished when the cable is played out so as to restrict the ball's velocity with respect to the water in the pipe because water rushing through the marginal space around the ball causes it to spin and scour the pipe's inner surface. In addition, water rushing past the ball at high velocity tends to wash solids ahead of the ball.

Fairly substantial obstructions can normally be cleared by "bouncing the ball", i.e. drawing it some distance upstream and then releasing it, driven by water pressure, against the obstruction. This entire process is known in common parlance in the trade as "balling out" a sewer pipe, or "sewer balling."

Despite its long and widespread use, the above-described manual sewer balling apparatus has several serious drawbacks. For example, since good cleaning requires the pressure of a considerable head of water behind the ball, pipes of any more than approximately eight inches in diameter are difficult to clean manually. The pressure required in larger pipes exceeds the strength and ability of the average operator to restrict the ball's velocity and to crank it upstream for bouncing against obstacles. Thus, the efficiency with which the manual apparatus can practically be used is limited to the strength of the operator turning the spool's crank handle.

Safety is also a problem with the manual apparatus. Unless removed, the crank handle spins freely in the bouncing operation, this having caused many injuries to operators attempting to control its motion. Bouncing also requires that the operator crank the heavy spool while in a bent position; this causes back injuries. In addition, bouncing often generates dangerous loops and slack in the cable. Finally, spools wound with sufficient cable to ball pipes of substantial length are heavy and, when mounted on a supporting frame, are cumbersome and difficult to position safely adjacent a manhole.

A powered apparatus has recently been used in this setting for the limited purpose of retrieving cable more quickly from conduits. That is, once a cable has been run through a conduit behind a ball, the ball is removed at the downstream end and this powered apparatus is engaged with the conventional manual spool and used to retrieve the cable alone. One such apparatus is fashioned from the power head of a chain saw wherein the saw's bar is replaced with a splined coupling. Unfortunately, this apparatus is unable to draw a ball upstream in a conduit against a head of water. And even when retrieving naked cable alone, it is heavy, noisy and dangerous. For example, snags in the cable are likely to pull the apparatus from the operator's grip.

Thus, there exists a need for a powered apparatus able to control a tether in a conduit during sewer balling and related operations. It should be capable of controlling a ball's downstream progress against a fairly wide range of pressure, including a substantial head of water. And, it should be able to draw a ball upstream against substantial pressure as well. Finally, it should be able to be positioned safely and securely adjacent a manhole, and should be simple to operate.

SUMMARY OF THE INVENTION

The apparatus of the present invention is adapted to overcome the above-noted disadvantages of prior devices and to fulfill the above-identified needs. It includes means, such as a winch, mounted on a frame for deployment and retrieval of a tether. In one aspect of the invention, the frame has means associated therewith for engaging an opening in a conduit, for example, a manhole. In another aspect, a plurality of braking systems is operable during tether deployment, each system being able to exert a different continuously variable range of constant resistance against deployment. This selection of braking resistances is advantageous in the sewer balling operation.

This apparatus is also generally useful for controlling other tethered instruments in conduits.

Thus, it is an object of the present invention to provide a compact, portable, powered tether controlling apparatus able to engage an opening in a conduit, wherein the opening is in a generally horizontal surface.

Yet another object of this invention is to provide a portable tether controlling apparatus having means extensible therefrom for engaging an opening in a generally horizontal surface, such as a manhole, and for biasing the weight of the apparatus against the engaging means using the force of the weight of the apparatus.

It is a further object of present invention to provide a tether controlling apparatus having a drive train and a plurality of braking systems adapted to controlling a tethered ball against water pressure in a sewer pipe.

Still further objects of the inventive tether controlling apparatus disclosed herein will be apparent from the drawings and following detailed description thereof.

BRIEF DESCRIPTION OF THE DRAWINGS

FIG. 3 For clarity in showing the structure of the power arm, the brake arm behind it is eliminated.

DESCRIPTION OF THE PREFERRED EMBODIMENT

Figure 1:
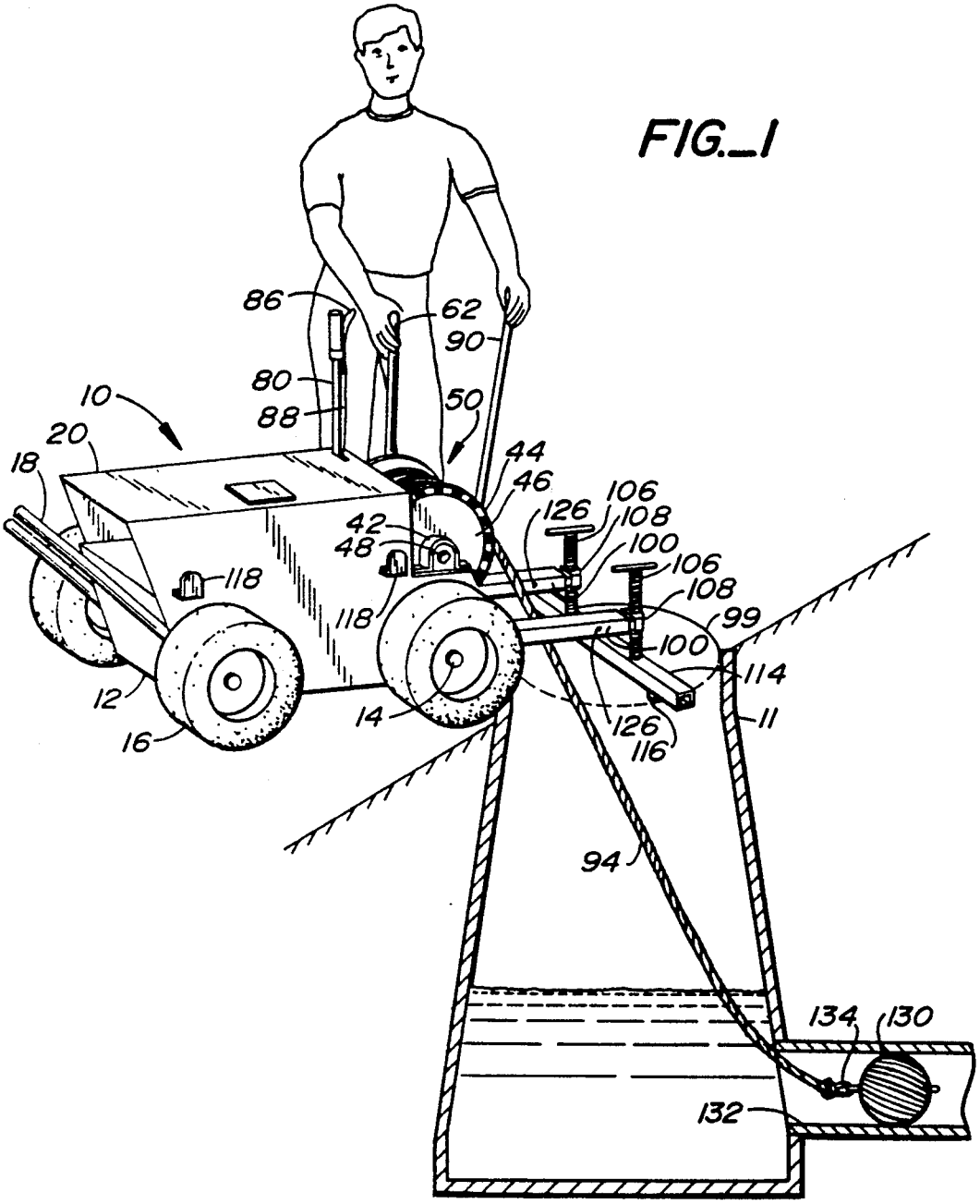
FIG. 1 is a perspective view of the inventive tether controlling apparatus positioned adjacent a manhole and being used in balling out a sewer pipe. The air gap normally used to deliver water to the manhole is eliminated here for clarity.
Figure 2:
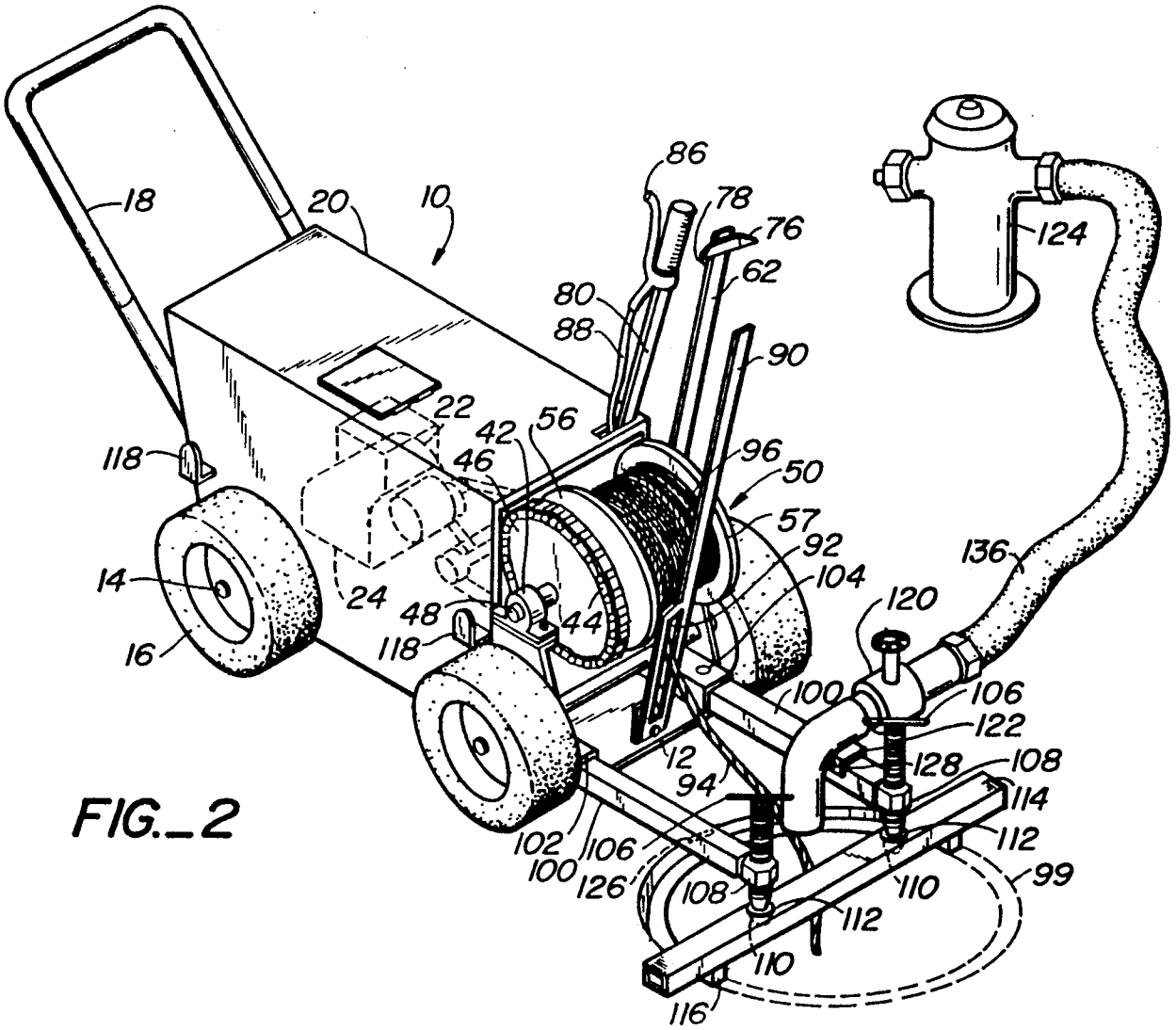
FIG. 2 is a perspective view from above the apparatus of FIG. 1 wherein an air gap is mounted on the apparatus' stabilizer arm for filling a manhole with water.

Referring now specifically to the drawings, FIGS. 1 and 2 show the tether-controlling apparatus of the present invention generally designated herein by reference numeral 10. FIGS. 1, and 2 show apparatus 10 in an environment where it lends particular advantage, that being adjacent a manhole 11 in position for "balling out" or otherwise controlling a cable in a sewer pipe or like conduit.

Apparatus 10 includes a frame 12 of rigid construction. Axles 14 and wheels 16 of conventional design are mounted on the frame for mobility of the apparatus. Handle 18 is rigidly bound to apparatus 10 and projects therefrom to aid in its being transported and positioned by an operator. Cover 20, upstanding from frame 12, houses a winch device, first including power driving means such as engine 22. Other power driving means such as an electric motor may alternatively be employed, but an engine is preferred for the mobility and power range it gives the apparatus. A 50 cc., 5 horse power, 2-cycle gasoline engine of the type commonly used in motor scooters has been employed with particular success for balling out conventional sewer pipes up to 18 inches in diameter. However, engines of different types and displacements may function well for this and related purposes.

Engine 22 is mounted transversely on frame 12, along with its original integral, infinitely variable-ratio transmission 24. Mounts 26 support engine 22 and transmission 24 on frame 12.

Figure 3:
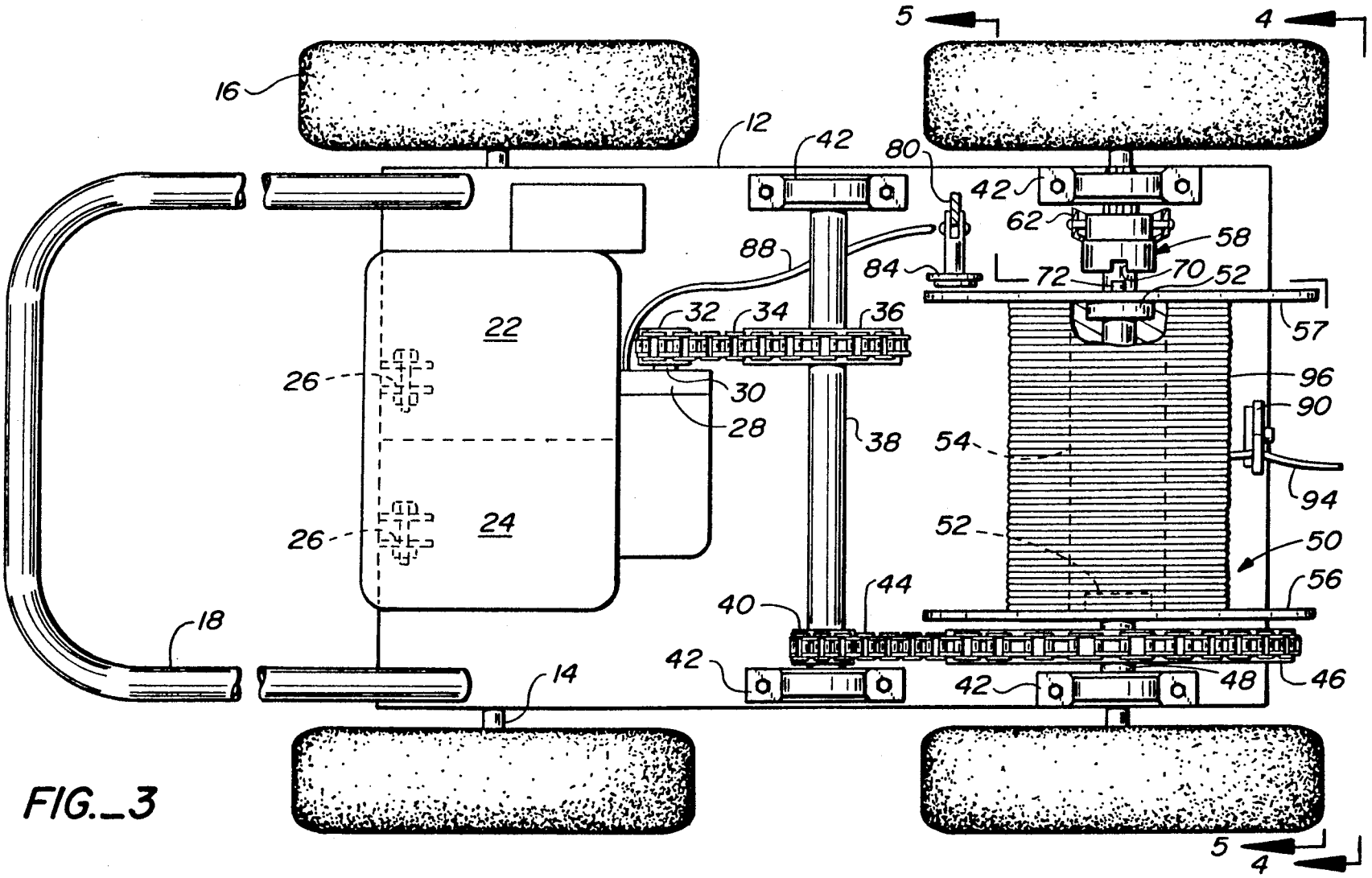
FIG. 3 is a sectional view of the frame-mounted elements of the inventive apparatus at the level of the top surface of its cover.

Transmission 24's output is through an internal automatic clutch, not shown, and through drum brake 28, to drive shaft 30 as shown in FIG. 3.

Torque is passed from a first sprocket 32 fixed to drive shaft 30, through a first drive chain 34 to a second sprocket 36 fixed to countershaft 38. Shaft 38 also carries third sprocket 40. Pillow blocks 42 support countershaft 38 at both its ends. Torque is further passed through a second drive chain 44 to fourth sprocket 46 fixed adjacent one end of spool shaft 48. As with countershaft 38, spool shaft 48 is supported by a pair of pillow blocks 42.

For balling pipes up to 18 inches, rotational speed reduction through the foregoing two-stage reduction sprocket set is preferably 7.5:1. In practice, a combination successfully used to achieve this includes sprocket 32 having 14 teeth and sprocket 36 having 35 teeth, this yielding a 2.5:1 reduction in the first stage. The second stage incorporates sprockets 40 and 46, having 14 and 70 teeth, respectively. This yields an additional 5:1 reduction, for a total of 7.5:1. Belt or gear-based systems, as well as other drive means, may be employed to similar ends.

Experience has also shown that a model of the apparatus 10 adapted to use in balling sewer pipes no larger than 8 inches, or so, preferably includes a reduction drive of 5.0:1. This permits an increased cable retrieval rate, while delivering sufficient power for balling these smaller pipes.

Spool 50 is mounted for rotation free and independent from spool shaft 48 on bearings 52 as shown in FIG. 3. Spool 50 includes a drum 54 and end plates 56 and 57, these plates being proximal and distal to fourth sprocket 46, respectively. See FIGS. 3–6.

Figure 7:
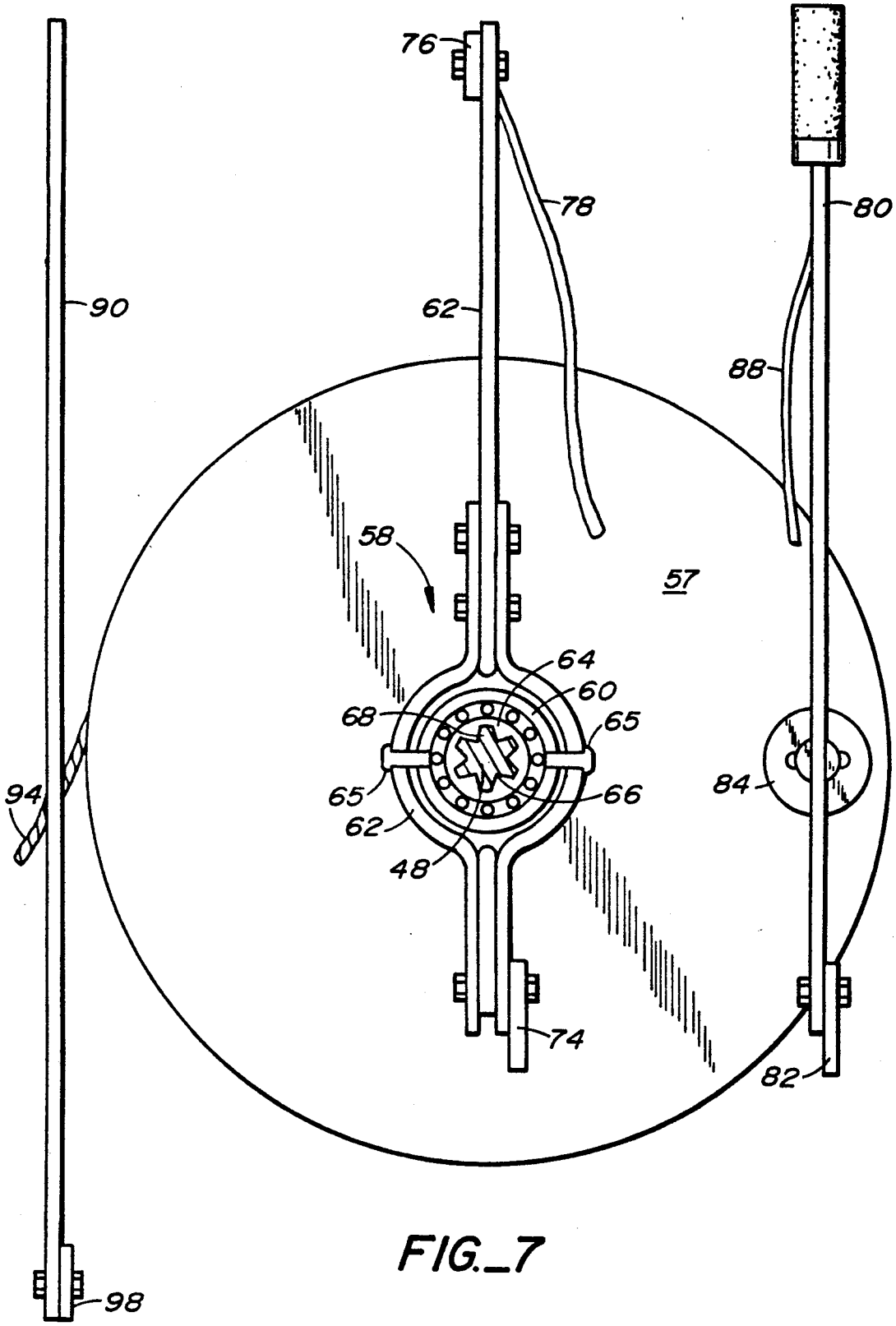
FIG. 7 is an enlarged side sectional view along lines 7—7 of FIG. 4 showing the apparatus' spool, positive clutch and brake pad.
Figure 8:
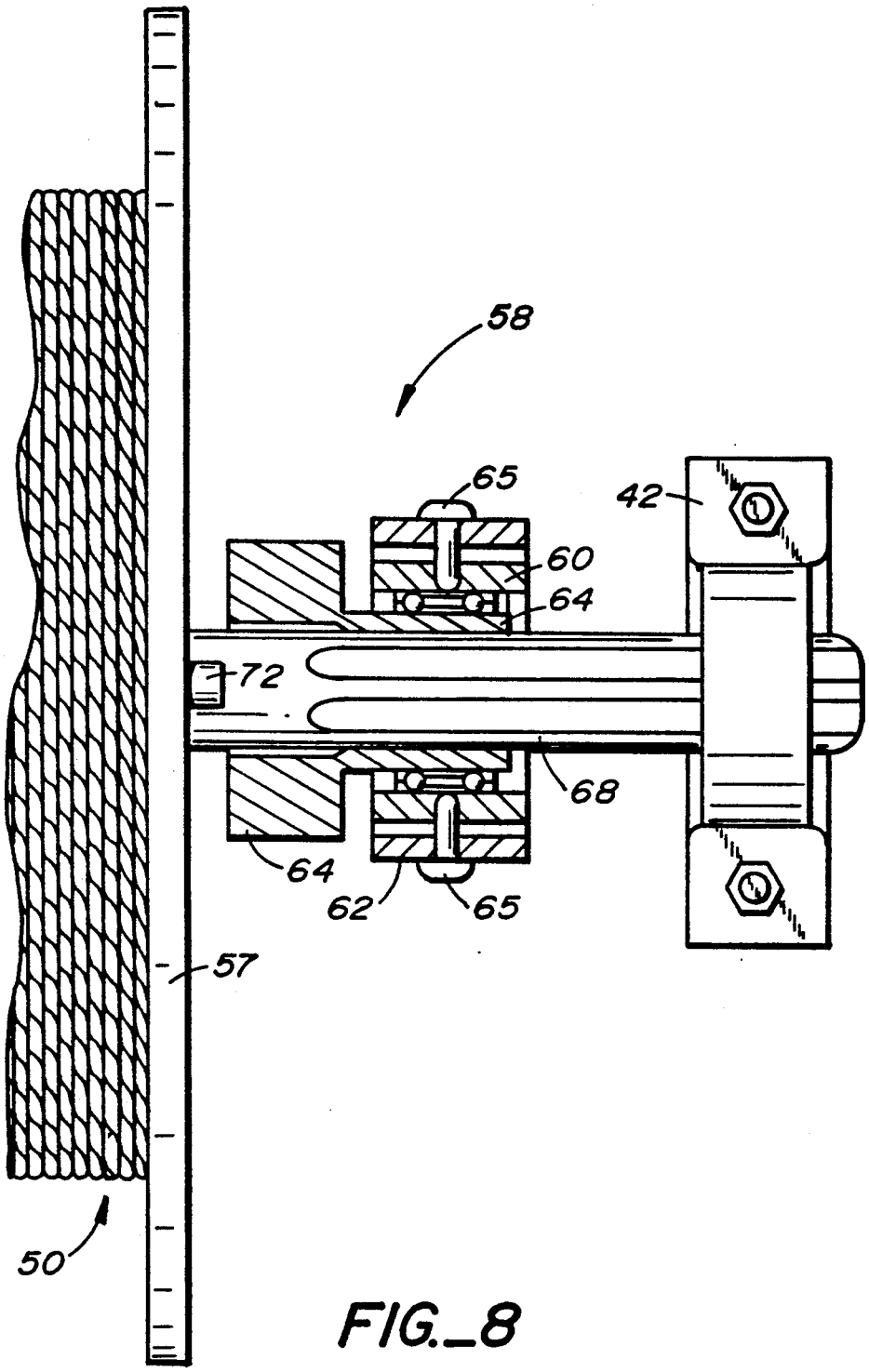
FIG. 8 is an enlarged sectional view of the apparatus' positive clutch.

Upon that end of spool shaft 48 farthest from fourth sprocket 46, a positive clutch such as dog clutch 58 is mounted. That is, spool 50 resides between dog clutch 58 and sprocket 46. As shown in FIGS. 7 and 8, dog clutch 58 is comprised of an outer annular member 60 pivotably mounted upon power arm 62, and an inner annular member 64 mounted on bearings for rotation upon fixed outer annular member 60. Outer annular member 60 pivots on horizontal supports 65 which are, in turn, fixed to power arm 62. Inner annular member 64 is fixed for positive rotation on, and axially slidable along, spool shaft 48 such as by inside splines 66 on its inside diameter mating with shaft splines 68 on spool shaft 48. Inner annular member 64 also has recesses 70 in its face which mate with rigid projections 72 from end plate 57 of spool 50.

Figure 4:
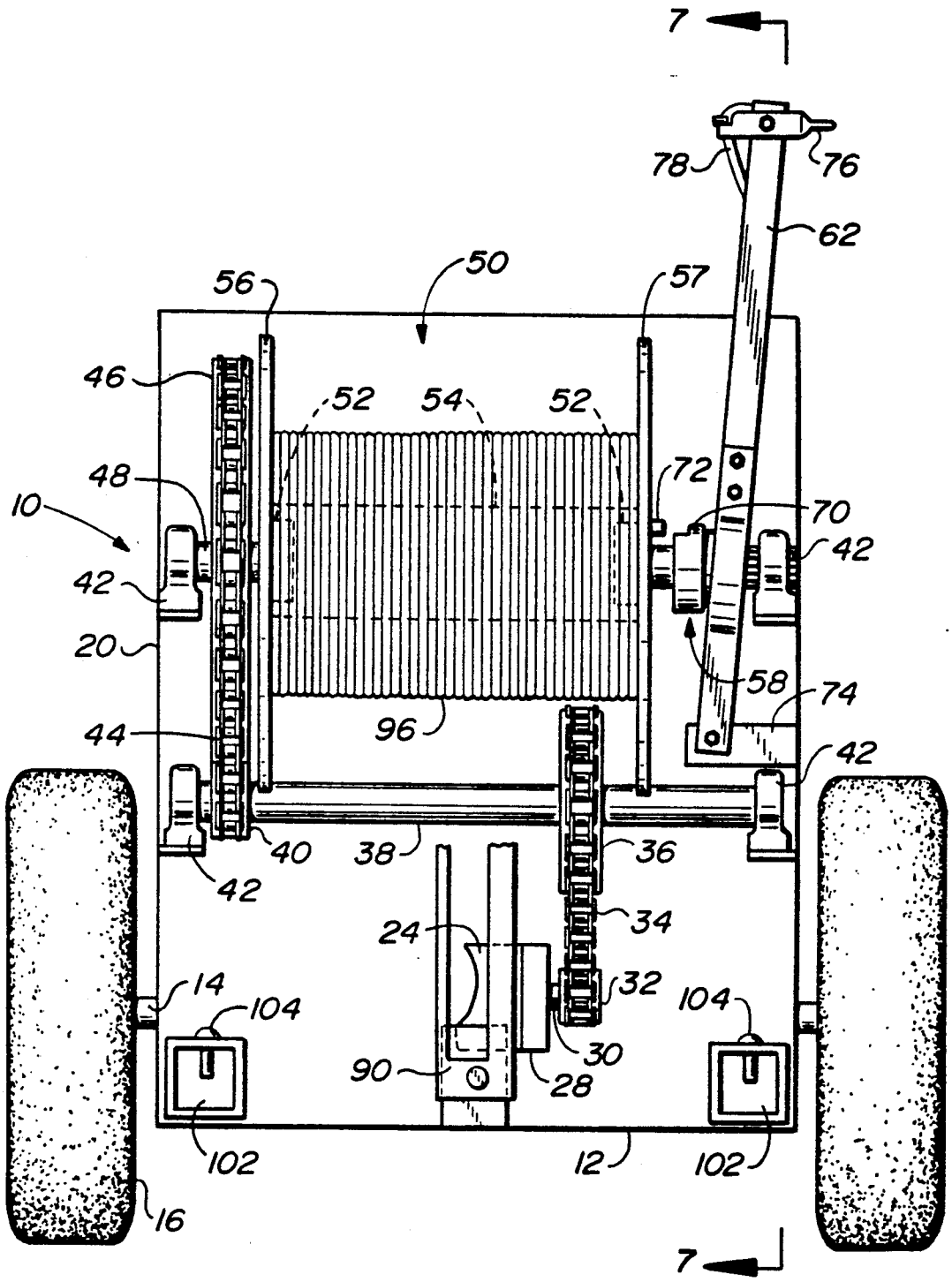
FIG. 4 is a sectional view of the apparatus along lines

Power arm 62 stands up from and pivots upon bracket 74 fixed to frame 12 below spool shaft 48 as shown in FIG. 4. Arm 62 travels through that vertical plane in which the axis of spool shaft 48 also resides. Some vertical play between arm 62 and its bracket 74 is desireable; this prevents clutch 58 from binding on shaft 48. Arm 62 also carries throttle tab 76 at its upper terminus, tab 76 being connected for speed control via throttle cable 78 to engine 12's carburetor.

Figure 5:
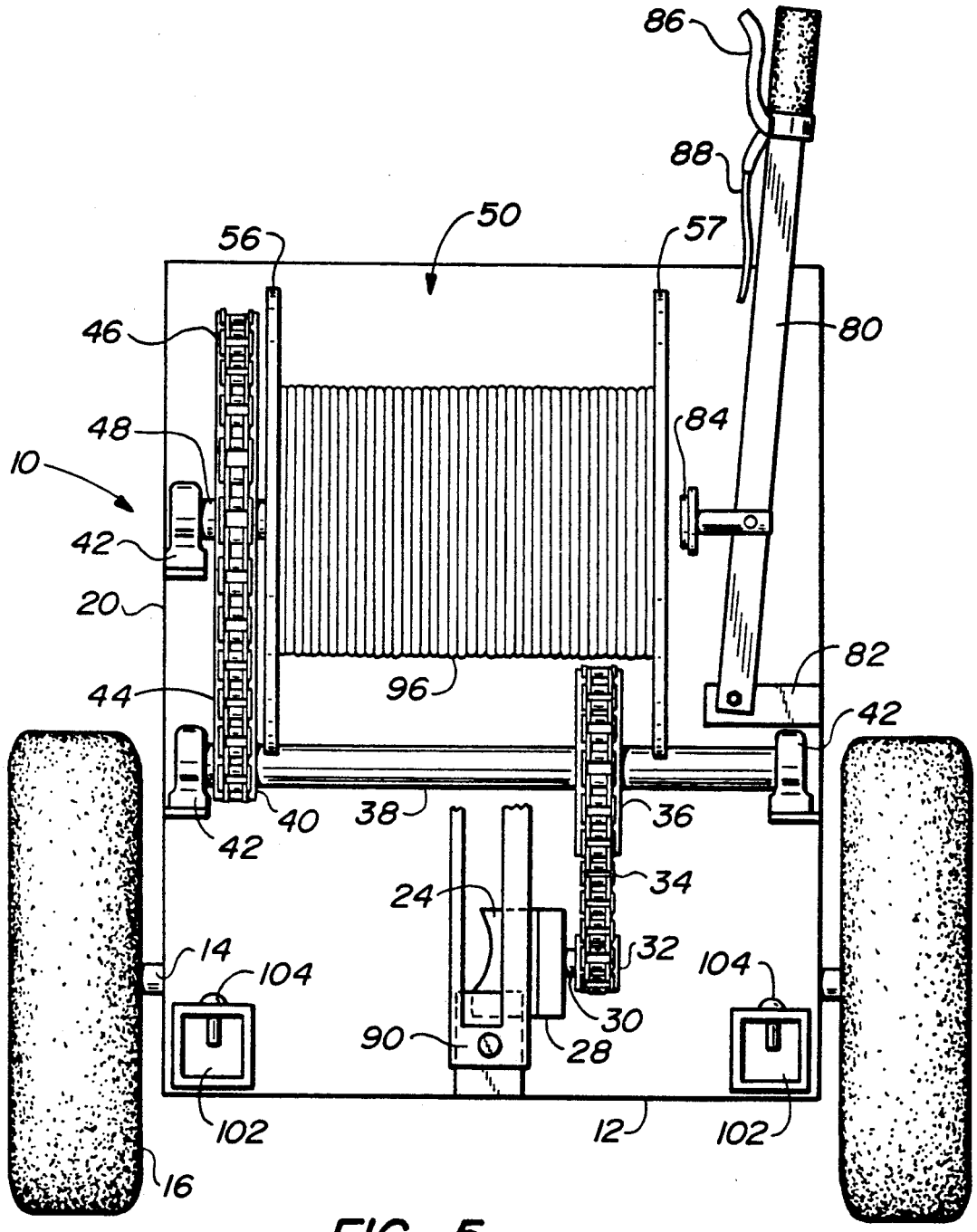
FIG. 5 is a sectional view of the apparatus along lines 5—5 of FIG. 3
Figure 6:
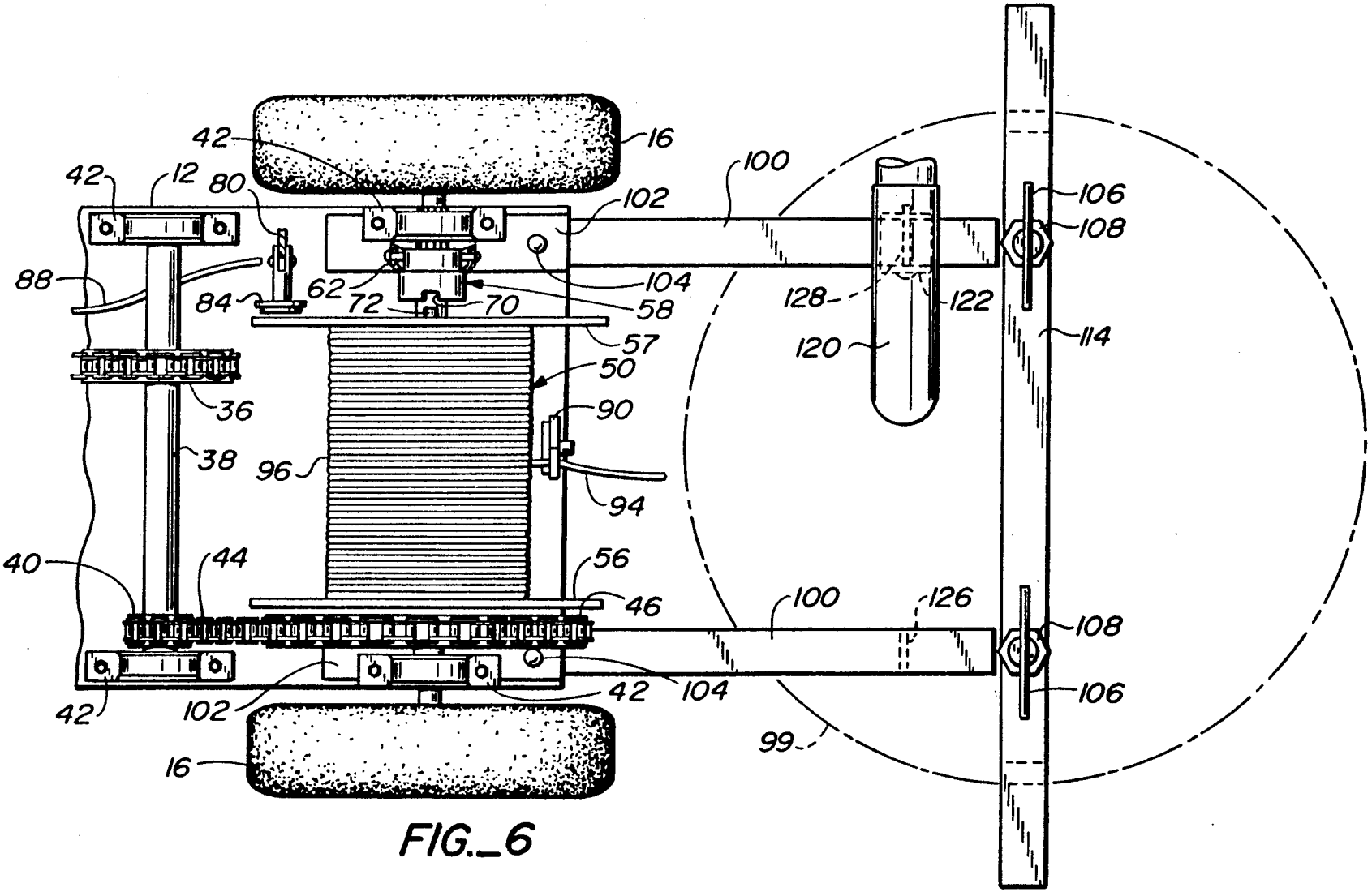
FIG. 6 is a view from above the front end of the apparatus at the level of the top surface of the apparatus' cover, showing its crossbar engaging a manhole is rim and its stabilizer arms supporting an air gap and engaging the crossbar.

As in FIGS. 3, 5 and 6, brake arm 80 stands adjacent spool end plate 57, and pivots upon frame-mounted bracket 82 travelling through a vertical plane parallel to spool shaft 48's axis. Approximately one-third of the way along its length from bracket 82, brake arm 80 carries brake pad 84. Pad 84 is placed so as to bear against end plate 57 when brake arm 80 is moved in that direction.

At its upper terminus, brake arm 80 also carries hand grip-actuated brake lever 86 which is connected via brake cable 88 to drum brake 28.

A third arm, level-winding arm 90, includes slot 92 which accommodates a cable strand 94 from cable supply 96 on drum 54. Arm 90 is pivotably mounted upon bracket 98 and able to be swept side-to-side across drum 54.

Means projecting beyond the periphery of apparatus 10's frame permit positive engagement of apparatus 10 with the rim of an opening in a generally horizontal surface, such as the rim or 99 of manhole 11. These means include a pair of parallel stabilizer arms 100, which stow during transport of apparatus 10 in parallel rectilinear channels 102 on opposite sides of frame 12.

When extended, arms 100 project generally horizontally, i.e. parallel to the surface, and held in place in channels 102 by pins 104. Each stabil arm 100 has a screw jack 106 perpendicularly disposed through a threaded aperture at its distal end 108.

Each jack 106 has an unthreaded tip 110 which seats in one of a pair of bosses 112 in crossbar 114. Crossbar 114 is preferably of a length somewhat greater than the width of the opening to be engaged, and it includes a pair of downward projections 116 spaced for snug engagement with the inside diameter of the rim 99. Crossbar 114 stows cradled behind upturned fingers 118 along the side of cover 20.

Stabilizer arms 100, channels 102, jacks 106 and crossbar 114 must be of such rigid and substantial construction so as to bear the weight of apparatus 10 easily when raised upon jacks 106 as in FIGS. 1 and 2, and to endure the added forces generated during sewer balling and other vigorous operations.

Water to power a sewer balling operation is supplied to a manhole via an air gap 120 connected to a hydrant 124, or the like. An air gap permits delivery of water to a manhole without the danger of contaminating a municipality's potable water supply. Air gap 120 has a bracket 122 on its underside spaced to receive the width of a stabilizer arm 100. Each stabilizer arm has an aperture 126 for receiving a pin 128 and securing bracket 122 to the arm.

In use, for example in balling out a sewer pipe, apparatus 10 is placed adjacent a manhole and its wheels are blocked. Alternatively, brakes, if provided, are engaged.

It is desirable that the apparatus be oriented opposite the manhole's outgoing, pipe as in FIG. 1 so as to avoid running the cable on the manhole's rim, and to attain the cable's most advantageous angle of attack. Crossbar 114 is removed from its cradle and placed, projections down, across the manhole. Stabilizer arms 100 are drawn forward from their channels 102, the tips of their jacks are mated with bosses 112 and pins 104 are dropped into place. Jacks 106 are turned clockwise raising the front wheels of the apparatus off the ground. The spacing of downward projections 116, and the force of the weight of apparatus 10 atop crossbar 114 prevents the crossbar, and thus apparatus 10, from moving in all directions lateral to the opening. Air gap 120 is positioned upon one of the stabilizer bars such that a hole in bracket 122 registers with the aperture 126 in the bar. Pin 128 is used to secure bracket 122 to the bar.

The cable end is threaded through slot 92 in arm 90 and a resilient, spirally-ribbed cleaning ball 130 approximating the diameter of pipe 132 is fastened to its end with thrust-swivel clip 134. Ball 130 is then fed into the pipe. Water from hydrant 124 is delivered into the manhole via a hose 136 to air gap 120, building up a head of several feet of water in manhole 11. This forces ball 130 along pipe 132, peeling cable off the drum as it goes.

In order to restrict the velocity of the ball with respect to the water, the operator moves brake arm 80 toward spool 50. This brings brake pad 84 into contact with spool end plate 57 and slows cable deployment, thereby maximizing the ball's spinning and scouring action. If more braking power is needed, brake pad 84 may be applied with great force against end plate 57 to stop spool 50's rotation momentarily. While stopped, dog clutch 58 may be engaged by moving power arm 62 toward spool 50, thereby linking the spool with the reduction sprocket drive train. At this point drum brake 28 becomes operable for increased braking power. Larger pipes, wherein balls of greater diameter are employed under increased water pressure, may require that dog clutch 58 be engaged from the start of the operation for the increased braking power of the drum brake.

When an obstruction is encountered and ball 130 is no longer carried through pipe 132 under the existing water pressure, the "bouncing" operation must be performed. If engine 22 is not already running, it is started up. And, if dog clutch 58 is not already engaged, it is engaged by moving power arm 62 toward spool 50, thereby linking the spool with the reduction sprocket drive train. Using throttle tab 76, the engine's speed is increased thereby engaging transmission 24's automatic clutch and beginning cable retrieval. In this manner the ball is drawn a desired distance upstream. To execute the "bounce," the dog clutch is released allowing the ball to be driven against the obstruction with the maximum water pressure possible. However, it is prudent to apply light braking resistance against the spool with brake pad 84 on arm 80 to avoid slack and dangerous loops in the cable. Bouncing may be repeated as necessary, building up a larger head of water behind the ball in the manhole, if necessary.

When cable is being retrieved, level winding arm 90 is used to guide the cable back and forth across the spool for neat and efficient storage. To reduce resistance against cable retrieval once the balling operation is complete, the ball is removed from the cable via a downstream manhole; or, the ball is left attached and the cable is rewound without any water pressure against the ball, that is, without any water in the manhole.

It should be particularly noted that the dual braking system employed permits a range of light to heavy resistance against cable deployment, as needed. Drum brake 28 operable with hand pressure applied to lever 86 gives heavy, but variable, braking action when linked to the spool through the reduction sprocket drive train. In contrast, pad 84 may be applied against spool end 57 with light to medium pressure on arm 80. The placement of these two braking systems on a single arm 80 makes them very easy to use in combination with but one hand. Note that the operator is able to isolate and control drum brake action with hand grip pressure, while independently controlling brake pad pressure by arm extension.

Power arm 62 has advantages similar to the brake arm in that more than one function is controlled thereby. Clutch engagement is controlled by the operator's arm extension, and throttle speed is controlled with finger pressure from the hand of the operator's same arm. Thus, the clutch and throttle are simultaneously controlled by manipulating power arm 62 and its throttle tab 76. Further, the close proximity of power arm 62 and brake arm 80 facilitates two-handed control of the balling and bouncing functions by the operator. The preferred arrangement of controls also facilitates cable retrieval because level winding arm 90 is positioned next to power arm 62.

Although apparatus 10's greatest presently-known advantage is in facilitating the sewer balling operation, it is also useful for related tasks. These include stringing flexible gas pipe, as well as television, telephone and other electrical cables through conduits. Further, as where it is desired to run a video camera through a sewer pipe to inspect its interior, the cables needed for this operation are more easily controlled. A pair of these inventive machines may even be used to propel a saw or various reaming tools to and fro in a pipe. However, in order to take best advantage of apparatus 10's being biased by the force of its own weight against an opening to assure secure engagement therewith, it is recommended that use be restricted to engagement with rims of openings in generally horizontal surfaces, such as conventional roadbeds, and the like, having a slope not exceeding, roughly 15°, or so.

The foregoing detailed disclosure of the inventive tether-controlling apparatus 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive device may later be realized. Accordingly, the scope of the invention should be determined with reference to the appended claims, and not by the examples which have herein been given.

I claim:

1. Apparatus for controlling movement of a tether in a conduit, wherein said conduit has an opening in a generally horizontal surface, said apparatus comprising, in combination:

a. a frame;

b. means mounted on said frame for deploying and retrieving a tether; and, c. a plurality of frictional braking systems operable during tether deployment, each said system being able to exert a different, continuously variable range of constant resistance against deployment.

2. The apparatus of claim 1, wherein a first braking system comprises a drum brake mounted upon a shaft engaged with a spool from which said tether is deployed, and wherein a second braking system comprises a member bearing a friction pad positioned adjacent said spool, said pad bearing member being operable to exert resistance against said spool.

3. The apparatus of claim 2, wherein said shaft is engaged with said spool through means for reducing the rotation speed of said spool with respect to said shaft.

4. The apparatus of claim 1, further including means extensible from said frame for engaging an opening in said conduit.

5. Apparatus for controlling movement of a tether in a conduit comprising, in combination:

a. a frame;

b. means mounted on said frame for deploying and retrieving a tether;

c. a plurality of frictional braking systems operable during tether deployment, each said system being able to exert a different, continuously variable range of constant resistance against deployment; and, d. means for engaging an opening in a conduit.

6. The apparatus of claim 5, wherein said opening engaging means comprises a pair of rigid parallel members extensible from said frame and mating securely with an elongate member placed across said opening, said elongate member having a length exceeding the width of said opening, said elongate member having a length exceeding the width of said opening and having a plurality of projections preventing lateral movement of said elongate member in said opening.

7. The apparatus of claim 6, wherein a first braking system comprises a drum brake mounted upon a shaft engaged with a spool from which said tether is deployed, and wherein a second braking system comprises a member bearing a friction pad positioned adjacent said spool, said pad bearing member being operable to exert resistance against said spool.

8. Apparatus for controlling movement of a tether in a conduit, wherein said conduit has an opening in a generally horizontal surface, said apparatus comprising, in combination:

a. a frame;

b. means mounted on said frame for deploying and retrieving a tether;

c. means extensible from said frame for engaging said conduit opening's rim; and, d. a plurality of braking systems operable during tether deployment, each said system being able to exert a different, continuously variable range of constant resistance against deployment.

9. The apparatus of claim 8, wherein a first braking system comprises a drum brake mounted upon a shaft engaged with a spool from which said tether is deployed, and wherein a second braking system comprises a member bearing a friction pad positioned adjacent said spool, said pad bearing member being operable to exert resistance against said spool.

10. The apparatus of claim 9, wherein said shaft is engaged with said spool through means for reducing the rotation speed of said spool with respect to said shaft.

11. Apparatus for controlling movement of a tether in a conduit, wherein said conduit has an opening in a generally horizontal surface, said apparatus comprising, in combination:

a. a frame;

b. means mounted on said frame for deploying and retrieving a tether; and, c. means extensible from said frame for engaging said conduit opening's rim, wherein said opening engaging means comprises a pair of rigid parallel members extensible from said frame and mating securely with an elongate member placed across said opening, said elongate member having a length exceeding the width of said opening and having a plurality of projections preventing lateral movement of said elongate member in said opening, and wherein at least one of said rigid parallel members includes means for securely binding an air gap thereto.

12. Apparatus for controlling movement of a tether in a conduit, wherein said conduit has an opening in a generally horizontal surface, said apparatus comprising, in combination:

a. a frame;

b. means mounted on said frame for deploying and retrieving a tether; and, c. a member extensible from said frame, said extensible member mating securely with an elongate member placed across said opening, said extensible member having a distal end and means for raising said end with respect to said elongate member, thereby using the force of the weight of said apparatus in securely mating said extensible member with said elongate member.

* * * * *